United States Patent [19]

Palmer

[11] 4,353,471

[45] Oct. 12, 1982

[54] APPARATUS FOR AND METHOD FOR LIFTING LARGE OBJECTS

[76] Inventor: Dalvin S. Palmer, 5466 W. Cambridge, Phoenix, Ariz. 85035

[21] Appl. No.: 136,168

[22] Filed: Mar. 31, 1980

[51] Int. Cl.[3] ..... B66C 23/06

[52] U.S. Cl. ..... 212/259; 212/262

[58] Field of Search ..... 212/232, 235, 237, 239, 212/242, 244, 251, 259, 260, 262, 255

[56] References Cited

U.S. PATENT DOCUMENTS

| | | | |
|---|---|---|---|
| 863,669 | 8/1907 | Suck | 212/251 X |
| 964,534 | 7/1910 | McGiffert | 212/255 X |
| 1,099,711 | 6/1914 | Merrill | 212/239 |
| 2,609,940 | 9/1952 | Grundvig | 212/262 |
| 2,666,532 | 1/1954 | Shoemaker | 212/240 |
| 2,697,527 | 12/1954 | Page | 212/262 |
| 2,855,110 | 10/1958 | Prichard | 212/244 X |

*Primary Examiner*—James L. Rowland
*Attorney, Agent, or Firm*—Harry M. Weiss

[57] ABSTRACT

This disclosure relates to an improved type of tension supported boom crane which uses a load distributor to provide a plurality of attachment points for the tension support, thereby allowing a load or loads to be connected to a corresponding plurality of support points, giving rise to a particular improvement in control for bulky loads.

This disclosure further relates to an improved method for controlling a bulky load with a tension supported boom crane by incorporating a load distributor in the supporting tension line allowing attachment of load cables to a bulky load at a plurality of points, and further allowing each of those load lines to be independently controlled.

6 Claims, 7 Drawing Figures

APPARATUS FOR AND METHOD FOR LIFTING LARGE OBJECTS

BACKGROUND OF THE INVENTION

1. Field of the Invention

This invention relates generally to an improved type of crane and, more specifically, to tension supported boom cranes which utilize one or more boom support lines to restrain the load sheave supporting boom.

2. Description of the Prior Art

In the past, cranes have been used extensively for lifting and, in particular, for structural erection. The mobile crane is particularly useful in this context. Mobile cranes commonly utilize a lattice type boom which is fabricated from light-weight members and functions as a compression member with a boom pivot at its lower end and a load sheave at its outer end, and is restrained by one or more boom support lines attached in tension at a single given distance from the boom pivot. Another common feature of a mobile crane is that, in addition to a main boom, an auxiliary boom is swung into place and locked, or otherwise attached to, the end of the main boom, providing an additional load sheave at a point more remote from the boom pivot thereby providing an increased reach at a reduced capacity. The load line is passed over the load sheave and singly or in combination with other parts of line lifts a load block when the load line is wound onto the load hoist drum.

A problem common to all cranes utilizing a single load block is that the attitude of the load is dependent upon the load block being attached directly to the center of gravity of the load. Failure to position the load block directly over the center of gravity will result in an inclined attitude of the load which may contribute to the load tilting, sliding, or even capsizing.

A further problem arises when a load is suspended from a single block in that, when the center of gravity is positioned under the single block, the load is in a state of balance and is, therefore, subject to unwanted movement from such forces as the wind.

A need existed for a boom type crane capable of supporting a load at a plurality of points along the length of the boom.

SUMMARY OF THE INVENTION

In accordance with one embodiment of this invention, it is an object to provide a tension supported boom type crane capable of supporting loads at a plurality of points along the length of the boom.

It is another object to provide a tension supported boom type crane capable of controlled handling of bulky loads.

It is a further object to provide a tension supported boom type crane not requiring that the center of gravity of the load be precisely centered under the load sheave.

It is yet a further object to provide a tension supported boom type crane capable of rotating a load in a vertical plane.

DESCRIPTION OF THE PREFERRED EMBODIMENTS

In accordance with one embodiment of this invention, a crane apparatus especially useful for lifting bulky loads is disclosed, comprising boom means provided with a boom and a plurality of load lines and at least one load hoist providing a plurality of lines for attaching to the load at spaced-apart portions thereof to facilitate distributed lifting of the load, and boom support means coupled to the boom means for providing a plurality of boom supports.

In accordance with another embodiment of this invention, a method for lifting a bulky load with a crane apparatus having a boom is disclosed comprising the step of lifting the object at spaced-apart portions thereof to facilitate distributed lifting of the load.

The foregoing and other objects, features, and advantages will be apparent from the following, more particular, description of the preferred embodiments of the invention as illustrated in the accompanying drawings.

Figure 1:
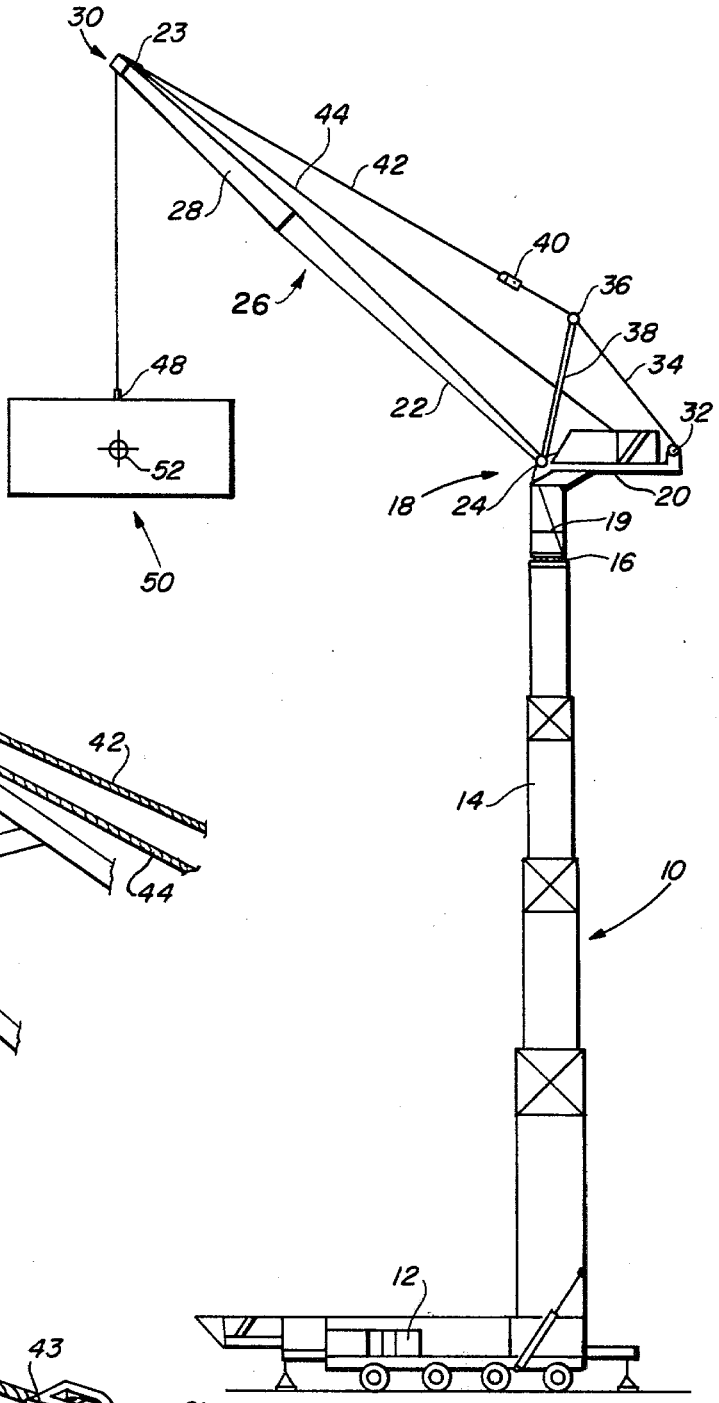
FIG. 1 (PRIOR ART)
FIG. 1 is a side elevational view of a conventional trailer-mounted, self-erecting crane apparatus lifting a load.

Referring to FIG. 1, a trailer-mounted, self-erecting crane apparatus, as was previously known, is shown generally by reference number 10. The crane apparatus 10 is mounted on a trailer 12 which supports a mast 14 which supports a bearing 16 which supports a jib head shown generally by reference number 18. The jib head 18 has a jib base 19, which can also be an operator's platform, which provides support for a machinery platform 20, a boom hoist line column 38, and a boom member, as for example, comprised of a main boom 22 pivotally attached at a boom pivot 24. The machinery platform 20 provides support for a boom hoist 32 and one or more load hoists (not shown).

The boom member, having the main boom 22, has a main boom sheave end shown generally by reference number 26 and is further comprised of an auxiliary boom 28 having an auxiliary boom sheave end 30 which auxiliary boom 28 mounts to the main boom sheave end 26. The main boom 22 and the auxiliary boom 28 are shown supported by a single boom support, as is old in the art, as for example, a boom line 42 having a clevis member shown by a clevis 43 (refer to FIG. 1A) attached by pin means as shown by a pin 41 to the auxiliary boom sheave end 30 at a boom line anchor member 23 provided with a plate attached to the boom apparatus having a hole (not shown).

It can be readily seen that the boom line 42 could alternatively be attached to the main boom sheave end 26, thereby providing for a shorter reach higher capacity hoisting capability. The boom support, as is old in the art, is further comprised of phantom block means, as for example, a phantom block 40 attached to the boom line 42, a boom hoist line sheave 36 which is supported by the boom hoist line column 38, a boom hoist line 34 which is reeved to the phantom block 40 and passes over the boom hoist line sheave 36, and the boom hoist 32 having a drum which is anchored to the boom hoist line 34. The main boom 22 and the auxiliary boom 28 may be elevated by driving the boom hoist 32 to wind the boom hoist line 34 onto the drum of the boom hoist 32, thereby moving the phantom block 40 toward the boom hoist line sheave 36 and causing the main boom sheave end 26 and the auxiliary boom sheave end 30 to rotate about the boom pivot 24. A load or an object shown generally by reference number 50, having a center of gravity 52, is supported by a load hook 48 supported by a load line 44 which passes over a sheave 46 (refer to FIG. 1A) supported by the auxiliary boom sheave end 30 and which load line 44 is further anchored to a drum of the load hoist 45 (not shown). The load 50 can be lifted toward the auxiliary boom sheave end by winding the load line 44 onto the drum of the load hoist (not shown).

Figure 2:
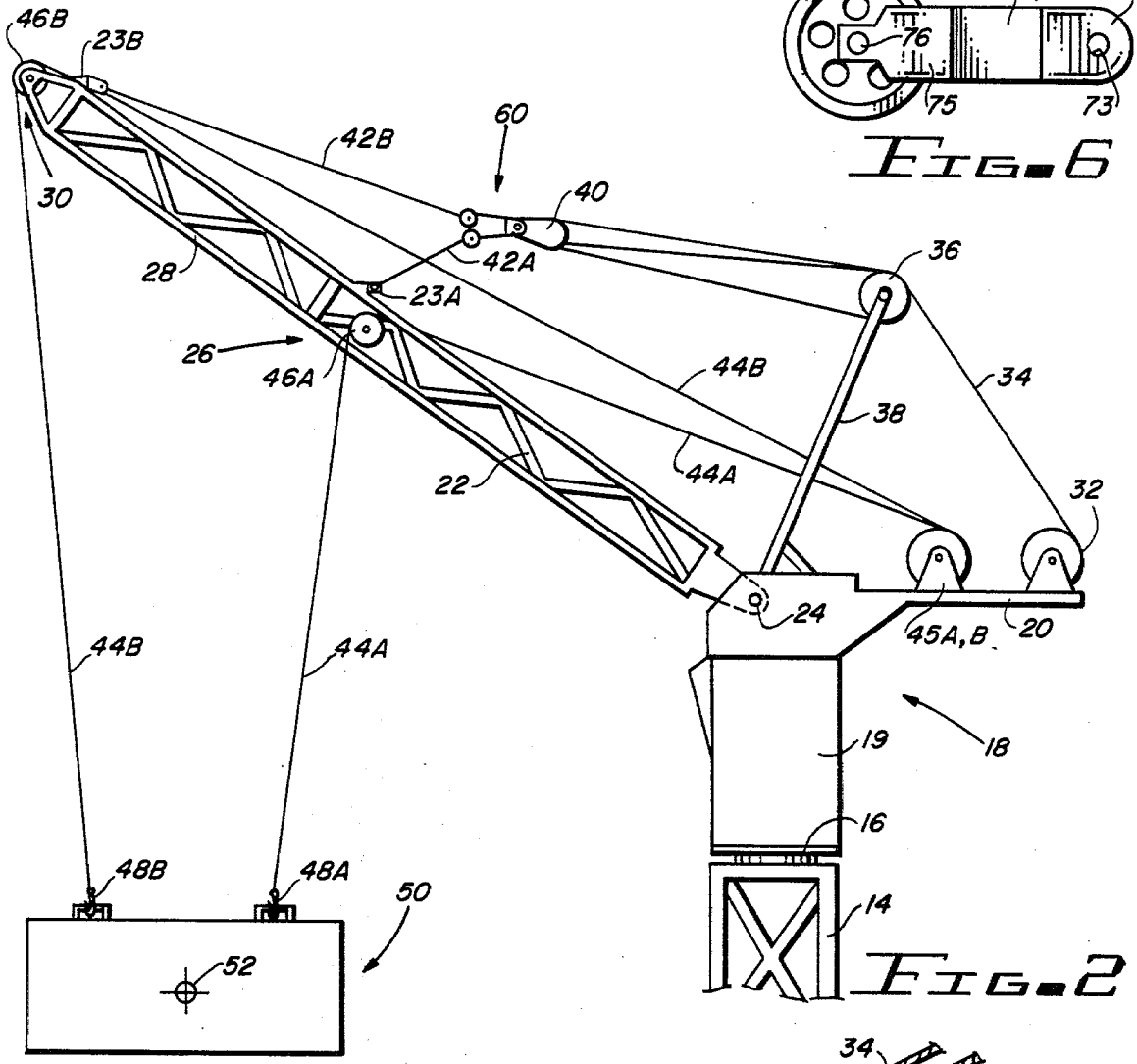
FIG. 2 is a side elevational view of a jib head of a crane apparatus incorporating the disclosed invention.

Referring to FIG. 2, an enlarged side elevational view of the jib head 18 of the crane apparatus incorporating boom support means for providing a plurality of boom supports, as is new in the art, is shown using the same numbers as used in reference to FIG. 1.

The crane apparatus is shown, for example, as comprised of boom means or apparatus for attaching to a load at a spaced apart portion thereof and boom support means or apparatus coupled to said boom for providing a plurality of boom supports. Boom means are shown as comprised of the jib head 18 having the jib base 19 which supports the machinery platform 20 (shown with the enclosure removed), the boom member having the main boom 22 and the rigidly attached auxiliary boom 28 pivotally attached to the jib head 18 at the boom pivot 24, a plurality of load lines having a main or first load line 44A and an auxiliary or second load line 44B respectively in communication with a main or first load sheave 46A coupled at a first distance from the jib base and an auxiliary or second load sheave 46B coupled at a second distance from the jib base 19 with the load lines 44A and 44B coupled respectively to a pair of load hooks 48A and 48B and to a pair of coaxial load hoists 45A and 45B supported by the machinery platform 20. The boom means are further comprised of a plurality of boom line anchor members as shown by a main boom line anchor 23A coupled at a first distance from the jib base and an auxiliary boom line anchor 23B coupled at a second distance from the jib base, each having a plate attached to the boom number having a hole (not shown).

Figure 1A:
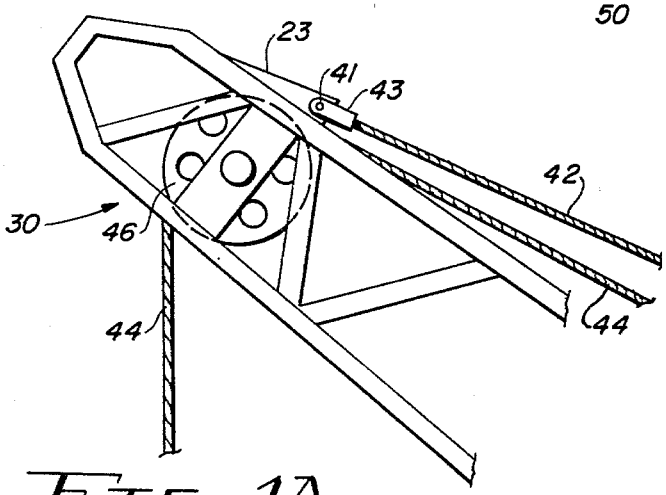
FIG. 1A (PRIOR ART)
FIG. 1A is an enlarged detail of an auxiliary boom end of a crane apparatus as shown in FIG. 1.
Figure 3:
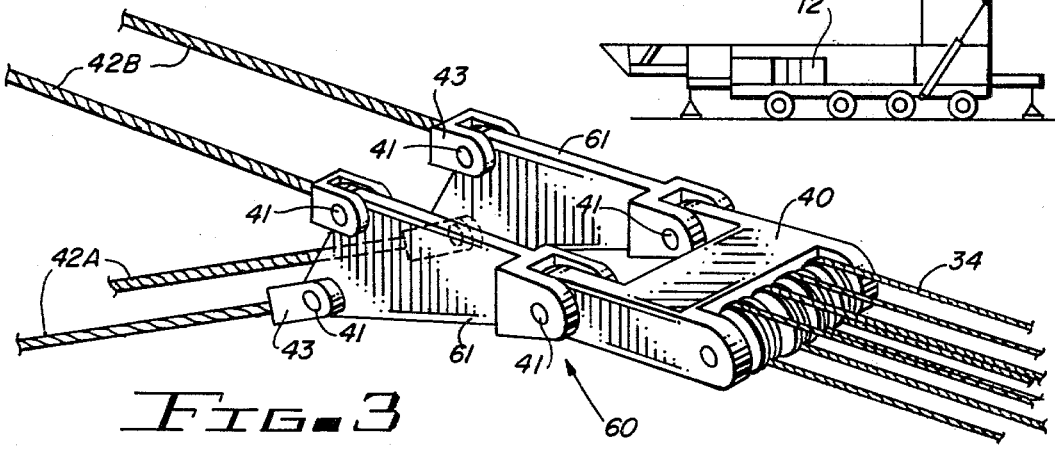
FIG. 3 is an enlarged elevational view of a preferred embodiment of a boom load distributor installed in the rigging of a crane apparatus.
Figure 5:
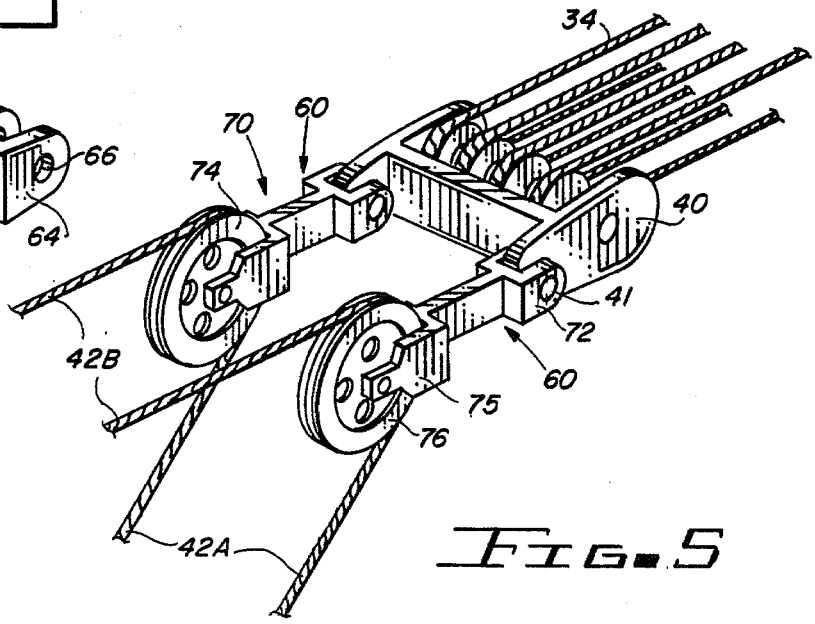
FIG. 5 is a perspective view of an alternate boom load distributor apparatus installed in the rigging of a crane apparatus.

Boom support means or apparatus for providing a plurality of boom supports is shown as comprised of boom load distributor means or apparatus 60 having the main boom line 42A attached to the main boom anchor member 23A and the auxiliary boom line 42B attached to the auxiliary boom anchor member 23B each by the clevis member 43 and the pin 41 as shown in FIG. 1A, the boom hoist 32 mounted on the machinery platform 20, the boom hoist line 34 coupled to the boom hoist 32, the boom hoist line column 38 attached to the jib base 19, the boom hoist line sheave 36 in communication with boom hoist line 34 and supported by the boom hoist line column 38, the phantom block 40 reeved to the boom hoist line 34, and the boom load distributor means 60 further provided with a boom line multiplier means or apparatus 61 for connecting the boom lines 42A and 42B to the phantom block 40 (refer to FIG. 3 and FIG. 5).

Referring to FIG. 3, an enlarged perspective view of one embodiment of a pair of boom load distributor apparatus 60, such as would be used for a crane apparatus 10 utilizing a duality of boom lines 42 for support of a single point along the length of a tension supported boom, is shown connected to the phantom block 40. The boom load distributor apparatus 60 is provided with the boom line multiplier means or apparatus 61, a pair of the main boom lines 42A connected to the boom line multiplier means 61, and a pair of the auxiliary boom lines 42B connected to the boom line multiplier means 61. Each of the boom lines 42 terminates in a clevis member having the clevis 43 having a plurality of holes, and each boom line multiplier apparatus 61 has a clevis member having a plurality of holes and is attached to a sleeve member, having a hole, of the phantom block 40 and to each of the plurality of clevises 43 by pin means, as for example, the pin 41. It will be apparent to one skilled in the art that the sleeve and clevis members could be transposed between connected elements without effect.

Figure 4:
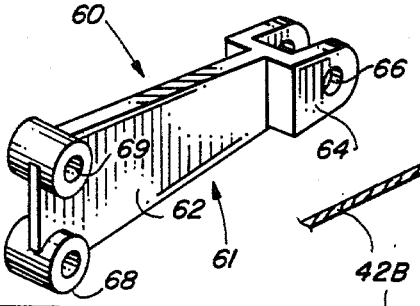
FIG. 4 is a perspective view of a preferred embodiment of a boom load distributor.

Referring to FIG. 4, a preferred embodiment of the boom load distributor apparatus 60 is shown as a boom line multiplier means, as for example, the multiplier apparatus shown generally by reference number 61. The boom line multiplier apparatus 61 has a boom line multiplier body 62 connected to a multiplier clevis means or member for attaching to the phantom block 40, as for example, a multiplier clevis 64 having a plurality of multiplier clevis holes 66 and the pin 41 and further connected to a multiplier bushing means or member for attaching to the clevis 43, as for example, a plurality of multiplier bushings 68 each having a multiplier bushing hole 69 and the pin 41.

Referring to FIG. 5, an alternate boom load distributor apparatus 60 is shown as a boom line equalizer means, as for example, a boom line equalizer apparatus shown generally by reference number 70. It can be seen that in this configuration each of the main boom lines 42A is continuous with each of the auxiliary boom lines 42B, and each of the lines 42 pass over an equalizer sheave 74.

Figure 6:
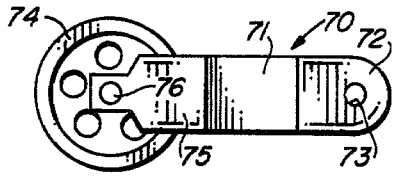
FIG. 6 is a side elevational view of an alternate boom load distributor apparatus.

Referring additionally to FIG. 6, it can be seen that the boom line equalizer 70 has a boom line equalizer body 71 which connects an equalizer clevis member 72, which can be connected to the phantom block 40 having the sleeve member having the hole by pin means, as for example, the pin 41, to a plurality of equalizer sheave arms 75 each having an axle bore (not shown) which, in a pair, support the equalizer sheave 74 on an equalizer sheave axle 76 resting in the axle bores. It can be seen that with the main boom line 42A and the auxiliary boom line 42B passing over the equalizer sheave 74 when the phantom block 40 is retracted toward the boom hoist line sheave 36 by winding the boom hoist line 34 onto the drum of the boom hoist 32, the equalizer sheave 74 will rotate about the equalizer sheave axle 76 allowing both the main boom line 42A and the auxiliary boom line 42B to adjust their relative lengths and to each remain in tension as the boom apparatus is rotated about boom pivot 24.

The operational advantage of the crane apparatus 10 utilizing the boom load distributor 60 will be apparent in that, since the main boom sheave end 26 and the auxiliary boom sheave end 30 can each be supported, the load 50 may be simultaneously supported by both the main load sheave 46A and the auxiliary load sheave 46B. Since the load 50 can be supported by the main load hook 48A and the auxiliary load hook 48B, the exact position of the center of gravity 52 of the load 50 is not critical as long as it remains between the connection points for the main load hook 48A and the auxiliary load hook 48B. Preferably, the main load hoist 45A and the auxiliary load hoist 45B can be separately controlled allowing main load hook 48A and auxiliary load hook 48B to be connected at different elevations on the load 50, and further allowing the main load line 44A and the auxiliary load line 44B to be wound at different rates onto the drums of the respective main load hoist 45A and the auxiliary load hoist 45B. The ability to raise or lower the respective load lines 44A and 44B at different rates further allows the load 50 to be rotated about the center of gravity 52 in a vertical plane. Alternatively, one single load hoist 45 having a drum having provision for winding or unwinding a plurality of load lines can be utilized.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A crane apparatus especially useful for lifting bulky loads, comprising:

boom means for attaching to said load at spaced-apart portions thereof;

boom support means coupled to said boom means for providing a plurality of boom supports;

said boom means comprising a jib base; a boom apparatus pivotally attached to said jib base, said boom apparatus having a plurality of load sheaves provided with at least a first distance from said jib base to a first load sheave and a second distance from said jib base to a second load sheave, said boom apparatus provided with a plurality of boom line anchor members, said boom line anchor members having at least a first distance from said jib base to a first boom line anchor member and a second distance from said jib base to a second boom line anchor member; a plurality of load lines coupled to said load and in communication with said plurality of load sheaves; said plurality of load lines including at least a first load line in communication with said first sheave and a second load line in communication with said second sheave; and at least one load hoist coupled to each of said load lines and supported by said sheave base;

said first distance to said first load sheave comprising approximately the same as said first distance to said first anchor member and said second distance to said second load sheave comprising approximately the same distance as said second distance to said second anchor member; and said boom support means comprising a boom hoist coupled to said jib base, a boom hoist line column supported by said jib base, a boom hoist line in communication with said boom hoist line sheave and anchored to said boom hoist, and said boom support means further comprising boom load distributor means for connecting said plurality of anchor members to said boom hoist line.

2. A crane apparatus in accord with claim 1 wherein said boom load distributor means comprising:

one or more boom lines;

said boom lines each having an attachment to at one of said anchor members; and multiplier means for connecting said one or more boom line to said boom hoist line.

3. A crane apparatus in accord with claim 2 wherein said multiplier means comprising:

a body member; and pin means for attaching an end of each of said boom lines to said body member and further for attaching said body member to said boom hoist line so that all of said boom lines can be simultaneously tensioned by said boom hoist line.

4. A crane apparatus in accord with claim 2 wherein said multiplier means comprising:

said boom lines each having opposed ends connected to a separate one of said anchor members;

a body member;

pin means for attaching said body member to said boom hoist line; and sheave means having at least a sheave rotatably supported by said body member for medially supporting one of said boom lines.

5. A method for lifting a bulky load with a crane apparatus, comprising the steps of:

lifting said load at spaced-apart regions thereof;

said step of lifting comprising the steps of attaching a plurality of load lines to said load, supporting said load lines with a corresponding plurality of sheaves, and winding said load lines onto one or more load hoists;

said step of supporting said load lines further comprising the step of supporting said sheaves with a boom apparatus;

said step of supporting said load lines further comprising the step of pivoting said boom apparatus about a pivot, spacing said sheaves at various distances from said pivot, suspending said boom apparatus from a plurality of boom lines connected to said boom at locations corresponding to the spacing of said sheaves, connecting said plurality of boom lines with a load distributor apparatus to a boom hoist line, and connecting said boom hoist line to an operable boom hoist.

6. A method in accord with claim 5, wherein sadi step of connecting said plurality of boom lines comprising the step of:

attaching the respective ends of each of said boom lines to said boom apparatus;

reeving a medial portion of each of said boom lines over a boom load line equalizer sheave; and coupling each of said equalizer sheaves to said boom hoist line.

* * * * *